US005533536A

United States Patent [19]

Hong

[11] Patent Number: 5,533,536

[45] Date of Patent: Jul. 9, 1996

[54] ADJUSTABLE CANE FOR PHYSICAL THERAPY

[76] Inventor: John Hong, No. 33, Alley 2, Lane 185, Sec. 2, Fu Chiang Rd., Yung Kang City, Tainan Hsien, Taiwan

[21] Appl. No.: 401,238

[22] Filed: Mar. 9, 1995

[51] Int. Cl.[6] ..... A45B 1/00

[52] U.S. Cl. ..... 135/65; 135/77

[58] Field of Search ..... 135/65, 66, 77, 135/79, 82, 84, 86

[56] References Cited

U.S. PATENT DOCUMENTS

| | | | |
|---|---|---|---|
| 3,289,685 | 12/1966 | Parker | 135/77 X |
| 4,062,372 | 12/1977 | Slusher | 135/66 |
| 4,091,828 | 5/1978 | Jorgensen | 135/66 |
| 4,601,302 | 7/1986 | Breen et al. | 135/66 |
| 4,947,882 | 8/1990 | Levasseur | 135/77 X |
| 4,997,001 | 3/1991 | Di Carlo | 135/77 X |
| 5,238,013 | 8/1993 | Battiston et al. | 135/77 X |
| 5,390,687 | 2/1995 | Tsai | 135/77 X |

*Primary Examiner*—Lanna Mai

*Attorney, Agent, or Firm*—Morton J. Rosenberg; David I. Klein

[57] ABSTRACT

An adjustable cane for physical therapy includes an adjustable base member and an elongated bar member detachably secured to the base member. The bar member comprises an elongated tube member and a longitudinal rod member slidably and adjustably received in the tube member. The base member is composed of a pair of identical base units each of which has an aperture at a center portion adopted to secure the bottom portion of the rod member therein, and a plurality of recesses adopted to secure supporting legs and linking rod members thereat. Whereas the linking rod member permit the supporting legs to be lifted upwardly for storage and to be put down for supporting user's weight.

1 Claim, 5 Drawing Sheets

ADJUSTABLE CANE FOR PHYSICAL THERAPY

FIELD OF THE INVENTION

This invention relates to a cane, and more particularly to a cane having an adjustable base member for varies purposes.

BACKGROUND OF PRIOR ART

Health is considered to be one of the greatest fortune in our daily life. Those people who have a physical problem require a special equipment to assist them, such as a cane which supports a disabled person to walk. This equipment enables disable person to move on their own and also to rehabilitate their physical capability, such as the cane 3 shown in FIG. 6 which comprises a tubular member 31 having a plurality of apertures 312 at bottom portion thereof, an enlongated rod member 32 having a protuberance 321 at a top portion thereof adopted to extend from one of the apertures 312. The bottom portion of the rod member 32 is secured to a base member 4 through a hole 411 of a plate 41 which includes four supporting legs 42 having one end of each soldered to the plate 41 and the other end of each leg 42 is terminated at an end 421 and covered by a rubber seat 422. This design provides user a good balancing support. However, the supporting legs 42 are at fixed placed which can not be relocated not be disassembled for storage.

It is the primary object of the present invention to provide an adjustable cane for physical therapy which supporting legs are adjustable for the convenience of different patients.

It is an other object of the present invention to provide an adjustable cane for physical therapy which is easy to operate.

It is a further object of the present invention to provide an adjustable cane for physical therapy which is easy to store and to carry.

DETAILED DESCRIPTION OF THE PREFERRED EMBODIMENT

Figure 1:
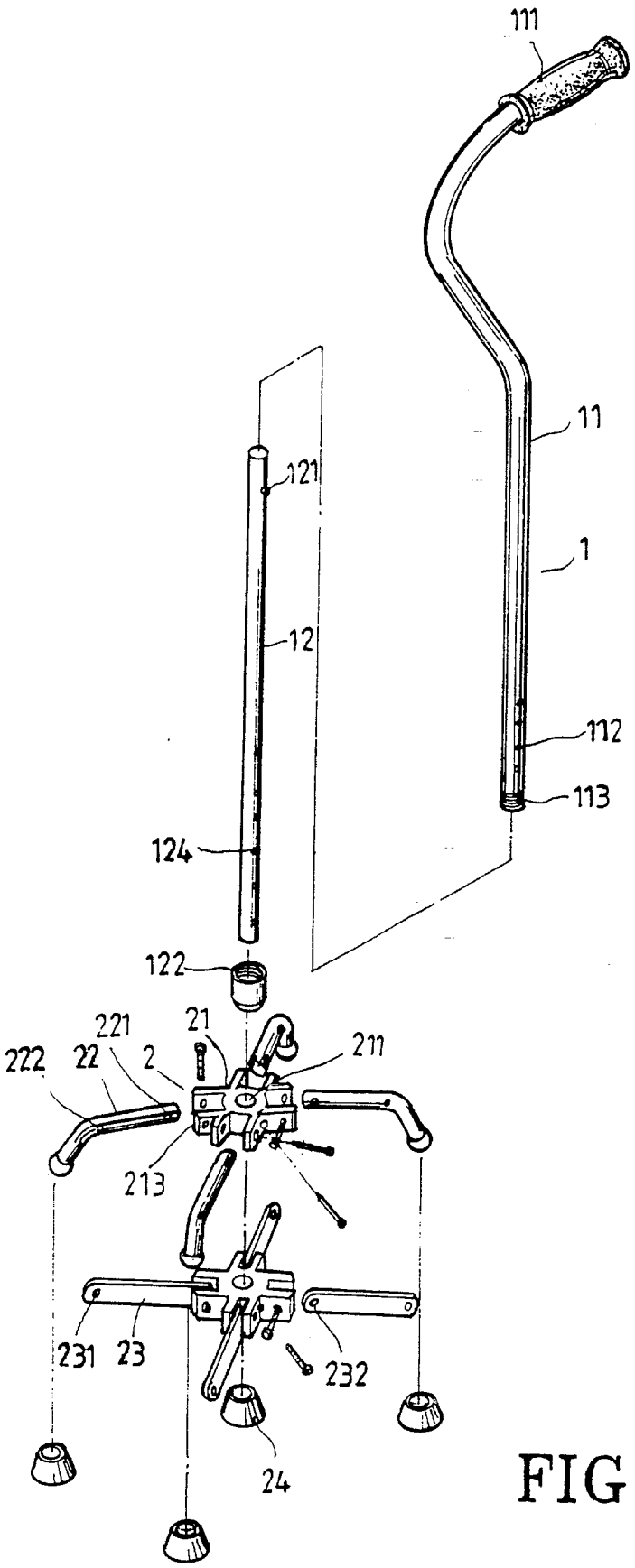
FIG. 1 is an exploded view of the present invention.

Referring now to FIGS. 1 through 5, wherein the showings are for the purpose of illustrating a preferred embodiment only and not for the purpose of limiting the inventive concept illustrated. FIG. 1 includes an elongated tubular member 11, a longitudinal rod member 12 slidably received within the tubular member 11, and a base unit 2 forming a cane 1 of the present invention.

The elongated tubular member 11 includes a handle 111 at top portion, a plurality of apertures 112 at bottom portion, and threads 113 at bottom periphery thereof to receive a female threaded ring 122.

The longitudinal rod member 12 is slidably received within the tubular member 11 and includes a protuberance 121 at a top portion and a plurality of apertures 124 at bottom portion thereof. The protuberance 121 is adapted to be inserted into any one of the apertures 112 to acquire a most suitable length to user. The apertures 124 are adapted to be secured to the base unit 2.

The base units 2 includes a first and a second blocks 21. The first block 21 has an aperture 211 at center portion adapted for the bottom portion of the elongated rod member 12 to insert therethrough, a plurality of plates 213 extendily outwardly from the block 21 having formed a plurality of recesses. A plurality of legs 22 are provided having one end of each secured to each recess by bolts and the other end of each legs covered covered with rubber seats 24.

Figure 2:
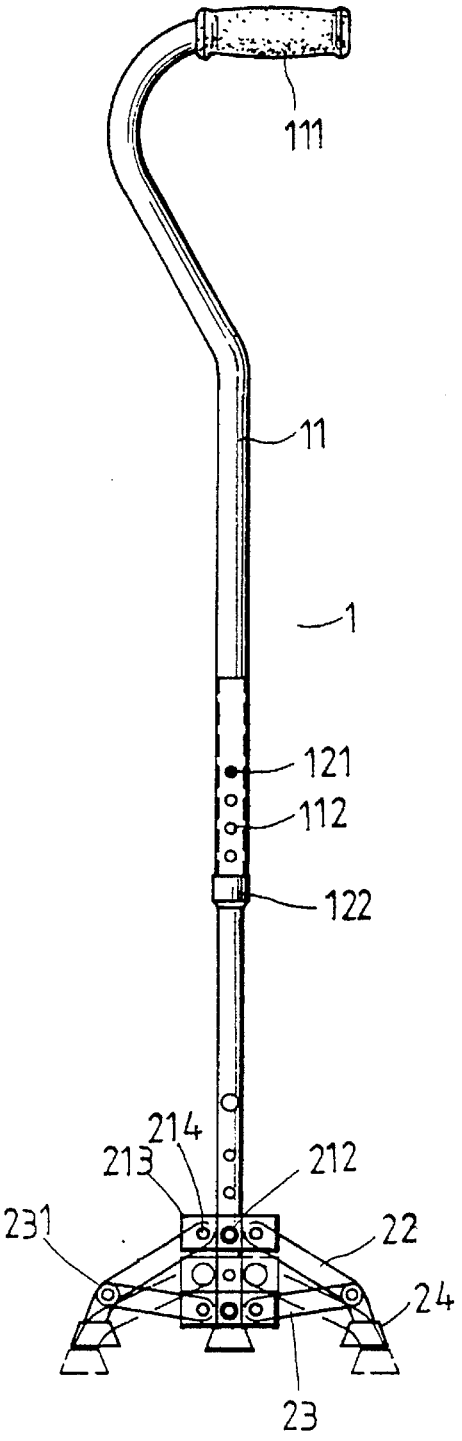
FIG. 2 is an elevational view of the present invention slowing supporting legs in the expending position.
Figure 3:
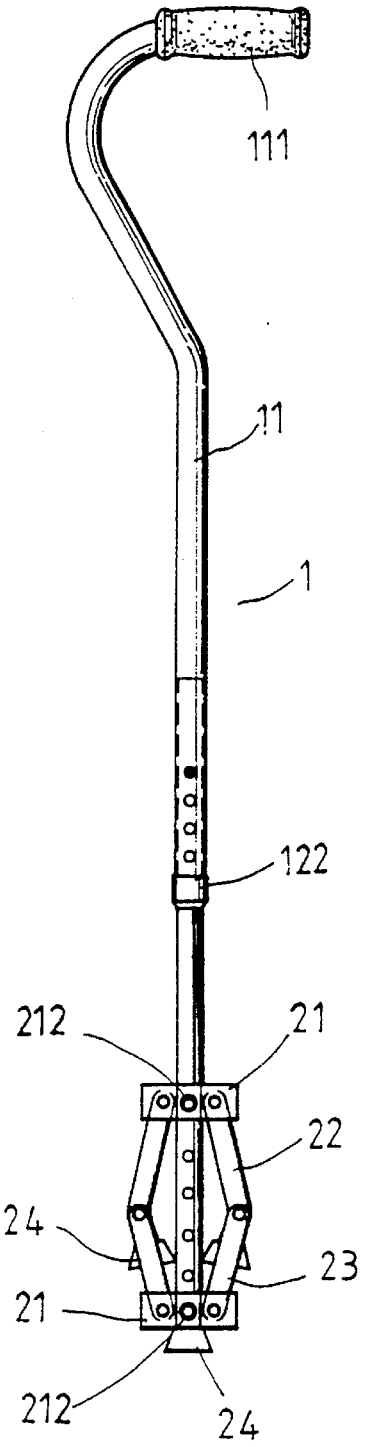
FIG. 3 is a further elevational view similar to FIG. 2 showing the supporting legs in the upright position.
Figure 4:
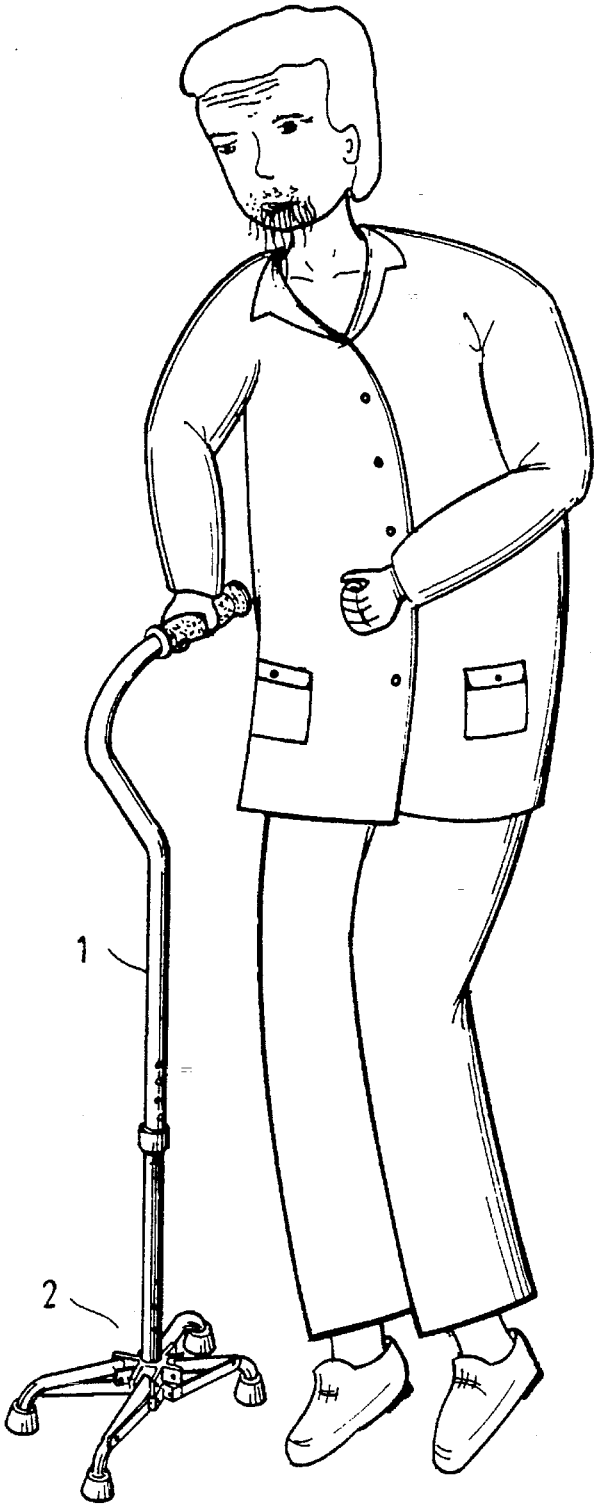
FIG. 4 is a perspective view showing the present invention being held by a person.
Figure 5:
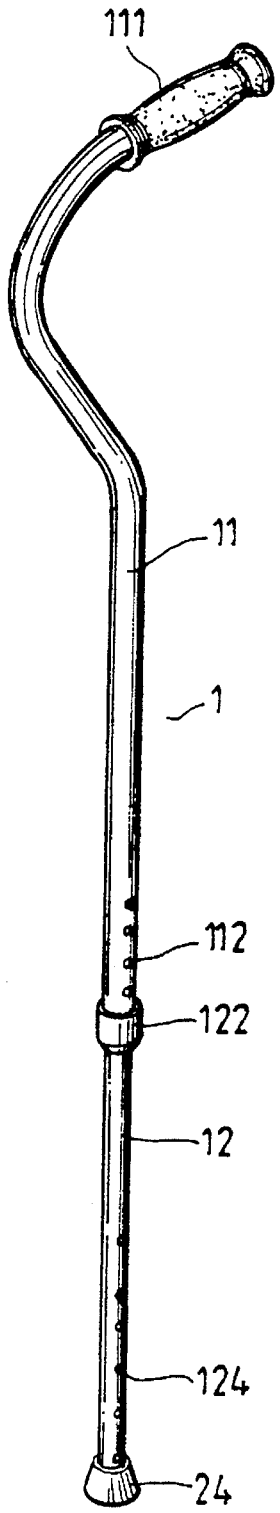
FIG. 5 is another perspective view of the present invention having the legs disassembled.
Figure 6:
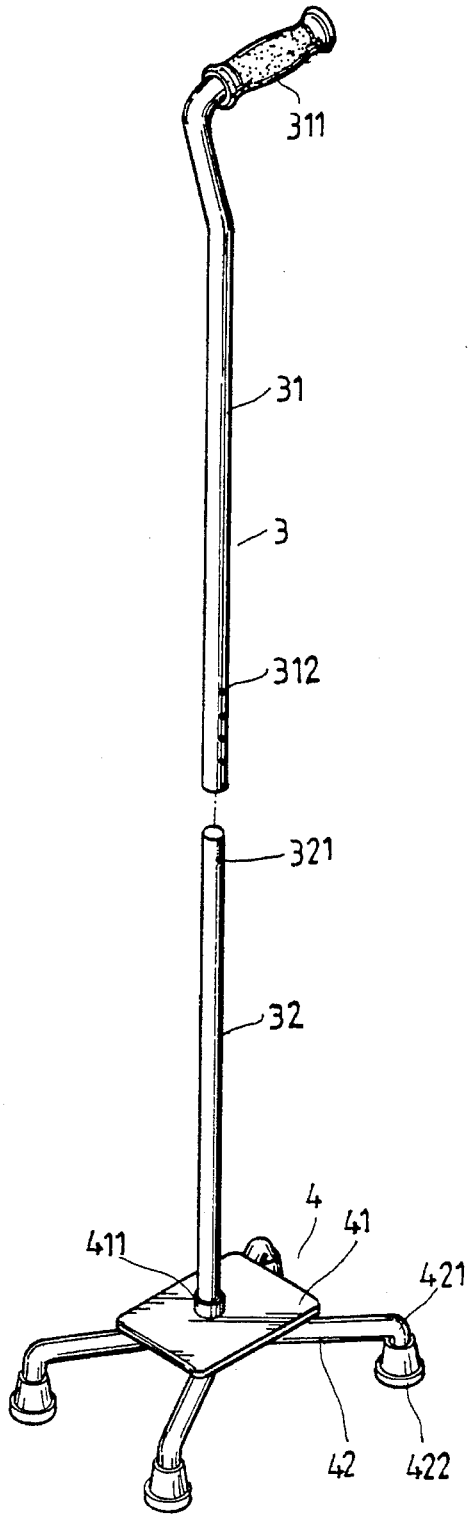
PRIOR ART FIG . 6
FIG. 6 is an exploded view of a prior art.

The second block 21 is identical to the first block 21 having each recess connected to one end of a linking rod members 23. The other end of each linking rod member 23 being secured through holes 231 and apertures 222 of the leg 22 by screws. The connection of the legs 22 to the first block 21 and the linking rod members 23 to the second block 21 and the legs 22 are in such a manner that when lifting up the linking rod members 23, the legs 22 will be lifted up simultaneously, as shown in FIG. 3, for storage convenience. On the contrary, when pushing the linking rod member 23, the legs 22 will also be brough downwardly, as shown in FIG. 2. A further function of the present invention is to disassemble the base unit 2 from the cane 1, and one end of the longitudinal rod member 12 is covered with a rubber seat 24, as shown in FIG. 5.

I claim:

1. An adjustable cane for physical therapy, comprising:

a longitudinally extended tubular member having opposing first and second ends, said first end having a plurality of longitudinally spaced first apertures formed therein;

a handle coupled to said second end of said tubular member;

a longitudinally extended rod member having a first end telescopically disposed within said first end of said tubular member, said first end of said rod member having a protuberance extending therefrom and adapted for releasable engagement with a selected one of said plurality of longitudinally spaced first apertures formed in said tubular member to provide a length adjustment of the cane, said rod member having a second end with a plurality of second apertures formed therein and extending from said second end of said rod member in longitudinally spaced relationship; and, base unit means retractably coupled to said second end of said rod member for providing an adjustable support base for the cane, said base unit means including:

a. a first block affixed to said second end of said rod member;

b. a second block having a central through bore for slidingly receiving said rod member therein, said second block having a opening formed through an outer wall thereof in open communication with said through bore and adapted for alignment with a selected one of said plurality of second apertures;

c. a plurality of leg members, each of said plurality of leg members having a proximal end pivotally coupled to said second block and extend radially therefrom;

d. a plurality of link members, each of said link members having one end pivotally coupled to said first block and an opposing second end pivotally coupled to a respective one of said plurality of leg members adjacent a distal end thereof; and e. a pin member extending through said opening formed in said second block and a selected one of said second apertures to adjust a radial distance between respective distal ends of said plurality of leg members.

* * * * *